US007162194B2

(12) United States Patent
Hotta et al.

(10) Patent No.: US 7,162,194 B2
(45) Date of Patent: Jan. 9, 2007

(54) IMAGE HEATING APPARATUS

(75) Inventors: Yozo Hotta, Shizuoka (JP); Hideo Nanataki, Kanagawa (JP); Taku Fukita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 10/784,874

(22) Filed: Feb. 24, 2004

(65) Prior Publication Data

US 2004/0202497 A1 Oct. 14, 2004

(30) Foreign Application Priority Data

Feb. 27, 2003 (JP) ..... 2003-051725
Feb. 23, 2004 (JP) ..... 2004-046455

(51) Int. Cl.
*G03G 15/20* (2006.01)

(52) U.S. Cl. ..... 399/328; 399/330; 399/331; 219/216

(58) Field of Classification Search ..... 399/328
See application file for complete search history.

(56) References Cited

U.S. PATENT DOCUMENTS

| | | | | |
|---|---|---|---|---|
| 5,051,784 | A * | 9/1991 | Yamamoto et al. | 399/329 |
| 5,210,579 | A * | 5/1993 | Setoriyama et al. | 399/338 |
| 5,331,385 | A | 7/1994 | Ohtsuka et al. | 355/290 |
| 5,525,775 | A * | 6/1996 | Setoriyama et al. | 399/335 |
| 5,881,349 | A | 3/1999 | Nanataki et al. | 399/328 |
| 5,920,757 | A | 7/1999 | Izawa et al. | 399/329 |
| 5,970,299 | A | 10/1999 | Sano et al. | 399/330 |
| 6,031,215 | A | 2/2000 | Nanataki et al. | 219/619 |
| 6,049,691 | A | 4/2000 | Abe et al. | 399/330 |
| 6,072,964 | A | 6/2000 | Abe et al. | 399/69 |
| 6,075,228 | A | 6/2000 | Goto et al. | 219/216 |
| 6,131,010 | A | 10/2000 | Kume et al. | 399/333 |
| 6,246,843 | B1 | 6/2001 | Nanataki et al. | 399/45 |
| 6,343,195 | B1 | 1/2002 | Abe et al. | 399/69 |
| 6,347,201 | B1 | 2/2002 | Sano et al. | 399/67 |
| 6,347,211 | B1 | 2/2002 | Nanataki et al. | 399/328 |
| 6,654,571 | B1 | 11/2003 | Nanataki et al. | 399/69 |
| 6,829,466 | B1 * | 12/2004 | Finn et al. | 399/329 |
| 2001/0019676 | A1 * | 9/2001 | Okubo et al. | 399/328 |
| 2002/0071700 | A1 * | 6/2002 | Nishitani et al. | 399/328 |
| 2003/0058320 | A1 | 3/2003 | Sano et al. | 347/103 |
| 2003/0118363 | A1 * | 6/2003 | Izawa et al. | 399/69 |

FOREIGN PATENT DOCUMENTS

| | | |
|---|---|---|
| JP | 8-129313 | 5/1996 |
| JP | 10-69176 | 3/1998 |
| JP | 10-232577 | 9/1998 |
| JP | 10-301417 | 11/1998 |

(Continued)

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

The present invention provides an image heating apparatus including:

a conveying roller for conveying the recording material;

a heat supply member which supplies heat to the conveying roller, the heat supply member being in contact with an external periphery of the conveying roller to form a heating nip portion;

a back-up member which forms a conveying nip portion in cooperation with the conveying roller for nipping and conveying the recording material;

wherein, in a rotating direction of the conveying roller, the heating nip portion has a width larger than a width of the conveying nip portion, and a total pressure applied to the conveying nip portion is larger than a total pressure applied to the heating nip portion.

6 Claims, 8 Drawing Sheets

FOREIGN PATENT DOCUMENTS

| | | |
|---|---|---|
| JP | 11-24489 | 1/1999 |
| JP | 11-73050 | 3/1999 |
| JP | 2000-19876 | 1/2000 |
| JP | 2002-62752 | 2/2002 |
| JP | 2002-123117 | 4/2002 |
| JP | 2002-221219 | 8/2002 |
| JP | 2002-236426 | 8/2002 |
| JP | 2003-29563 | 1/2003 |

* cited by examiner

IMAGE HEATING APPARATUS

BACKGROUND OF THE INVENTION

1. Field of the Invention

The present invention relates to an image heating apparatus for heating an image borne by a recording material, and more particularly to an image heating apparatus adapted for use as a heat fixing device in an image forming apparatus such as a copying machine or a printer.

2. Related Background Art

In an image forming apparatus based for example on an electrophotographic process or an electrostatic recording process, a fixing apparatus as a heating apparatus for heat fixation of an unfixed toner image formed on a recording material (a transfer sheet, a printing sheet, a photosensitive sheet, an electrostatic recording sheet etc.) by a transfer process or a direct process is known in various types and configurations such as a heat roller type, a film heating type etc.

In a color image forming apparatus for forming a toner image of plural colors on a recording material, or in an image forming apparatus having a color image forming function for forming a toner image of plural colors on a recording material, a toner amount of an unfixed toner image formed on the recording material is several times larger in a full color mode than in a monochromatic mode.

As a fixing apparatus capable of satisfactory heat fixation even of an unfixed toner image of such large toner amount, there is known an apparatus employing an elastic surface roller, which is provided with an elastic layer on a fixing roller (heating rotary member) constituting a fixing member for heat fixing the toner image on the recording material.

By constructing the fixing roller as an elastic surface roller, the surface of the fixing roller undergoes elastic deformation, relative to the unfixed toner image on the recording material, corresponding to irregularities of such toner image and achieving a wrapping contact with the surface of the toner image, whereby an unfixed toner image having a large toner amount can also be heat fixed in satisfactory manner.

However, in a fixing roller equipped with an elastic layer, the elastic layer itself constitutes a heat insulating layer and there is encountered a drawback that the heat transfer efficiency deteriorates in cases where the heat source is provided inside the fixing roller.

Therefore, the present applicant already proposed, as disclosed in Japanese Patent Application Laid-Open No. 2002-236426, a fixing apparatus adopting an external heating configuration in which a heating rotary member serving as a fixing member is heated from the exterior of the fixing member, whereby the fixing member has a high heating efficiency even in case it is provided with an elastic surface, thereby ensuring a quick starting property and a fixing ability of the apparatus.

FIG. 6 shows an embodiment of a fixing apparatus with such external heating configuration for the fixing member. A fixing roller 201 serves as a fixing member maintained in contact with an image bearing surface of a recording material P, thereby heat fixing an unfixed toner image T thereon. The fixing roller 201 is an elastic surface roller of a three-layered structure, having, in succession from the inside to the outside, a metal core 211, an elastic layer 212 and a releasing layer 213.

A pressurizing apparatus 202 is in a mutual pressed contact with the fixing roller 201, thereby forming a fixing nip portion N4 for nipping and conveying the recording material P. The pressurizing apparatus 202 also serves as a heating apparatus for heating the fixing roller 201, and is provided with a rotatable cylindrical film 221, and a film/heater holder 224 for supporting the film from the inside and maintaining it in contact across a plate-shaped heater 222 thereby forming the fixing nip portion N4.

In addition to the aforementioned pressurizing/heating apparatus 202, there is provided an external heating apparatus 203 for heating the surface of the fixing roller 201 from the exterior. The external heating apparatus 203 is provided with a plate-shaped heater 232 and a heater holder 234 for supporting the heater so as to be in contact with the surface of the fixing roller 201 thereby forming a fixing roller heating nip portion N3.

The fixing roller 201 is rotated clockwise, as indicated by an arrow, by an unillustrated drive mechanism. By such rotating motion of the fixing roller 201, the cylindrical film 221 of the pressurizing/heating apparatus 202 is driven counterclockwise, as indicated by an arrow, around the holder 224, with an internal surface of the film in sliding contact with the surface of the plate-shaped heater 222 at the fixing nip portion N4.

The plate-shaped heater 222 in the pressurizing/heating apparatus 202 and the plate-shaped heater 232 in the external heating apparatus 203 are so-called ceramic heaters, of which temperature is rapidly elevated by current supplies from power supply circuits 205, 206 to heat-generating resistor layers (not shown). Temperatures of the heaters 222, 232 are detected by thermistors 223, 233 constituting temperature detecting means provided on rear surfaces of the heaters, and temperature information thus detected are supplied to a control circuit (CPU) 204.

The control circuit 204 executes a temperature control of the heater 222 by controlling the current supply from the power supply circuit 205 to the plate-shaped heater 222 in the pressurizing/heating apparatus 202 in such a manner that a temperature detected by the thermistor 223 is maintained at a predetermined heater temperature. It also executes a temperature control of the heater 232 by controlling the current supply from the power supply circuit 206 to the plate-shaped heater 232 in the external heating apparatus 203 in such a manner that a temperature detected by the thermistor 233 is maintained at a predetermined heater temperature.

In this manner the surface temperature of the fixing roller 201 is maintained at a predetermined surface temperature (fixing temperature) necessary for the heat fixation of the toner image.

As the fixing roller 201 is rotated to drive the film 221 of the pressurizing/heating apparatus 202 in a rotating motion, and as the plate-shaped heater 222 of the pressurizing/heating apparatus 202 and the plate-shaped heater 232 of the external heating apparatus 203 are powered to control the heaters 222, 232 at the predetermined heater temperatures, the surface of the fixing 201 is heated by the heat of the plate-shaped heater 222 of the pressurizing/heating apparatus 202 across the film 221 at the fixing nip portion N4, and is also heated by the heat of the plate-shaped heater 232 of the external heating apparatus 203 at the heating nip portion N3, whereby the fixing roller 201 is heated to a predetermined surface temperature (fixing temperature) required for heat fixing the toner image.

In such state, a recording material P bearing an unfixed toner image T is introduced into the fixing nip portion N4, with a toner image side at the side of the fixing roller 201, whereby the recording material P is nipped and conveyed in the fixing nip portion N4. In such conveying process, the unfixed toner image T is fixed, under a heat and a pressure, as a permanent image on the surface of the recording material P by the heat of the fixing roller 201. The recording material P emerging from the fixing nip portion N4 is separated from the surface of the fixing roller 201 and is conveyed for discharge.

Such apparatus, being provided with heating means for externally heating the surface of a fixing member such as a fixing roller, can rapidly elevate the temperature by rapid heating of only the surface, required for fixing, of the fixing member, and can improve the quick starting property and the thermal efficiency of the fixing apparatus even in case the fixing member is an elastic surface roller having an elastic layer.

In a fixing apparatus of an external heating configuration as explained in the foregoing, in order to maintain the surface temperature of the fixing roller heated by the external heating means as close as possible to a predetermined surface temperature necessary for heat fixation of the toner image thereby ensuring a fixing property for a first print immediately after the start of power supply or for all prints during a continuous sheet passing operation, it is desirable (1) to increase an electric power supplied to a heater of the external heating means, and (2) to increase a width of the heater of the external heating means.

However, an increase in the electric power supplied to the heater of the external heating means may result in a deterioration of components such as the fixing roller or the heater, or a runaway state of the heater, by a rapid temperature increase in the heater. Also a larger width of the heater of the external heating means may lead to a drawback of an increased cost of the heater.

SUMMARY OF THE INVENTION

The present invention, which has been made in consideration of the foregoing problems, has an object of providing an image heating apparatus having a fast start-up time to a temperature capable of sufficiently heating an image and also capable of ensuring a satisfactory fixing ability.

Another object of the present invention is to provide an image heating apparatus capable of ensuring a satisfactory fixing ability while suppressing a cost of a heater.

Still another object of the present invention is to provide an image heating apparatus including:

a conveying roller for conveying a recording material;

heat supply means which supplies heat to the conveying roller, the heat supply means and an external periphery of the conveying roller being in mutual contact to form a heating nip portion;

back-up means which forms a conveying nip portion in cooperation with the conveying roller for nipping and conveying the recording material;

wherein, in a rotating direction of the conveying roller, the heating nip portion has a width larger than a width of the conveying nip portion, and a total pressure applied to the conveying nip portion is larger than a total pressure applied to the heating nip portion.

Still other objects of the present invention will become fully apparent from the following detailed description, which is to be taken in conjunction with accompanying drawings.

DETAILED DESCRIPTION OF THE PREFERRED EMBODIMENTS

In the following, embodiments of the present invention will be explained with reference the to accompanying drawings.

(First Embodiment)

(1) Example of Image Forming Apparatus

Figure 5:
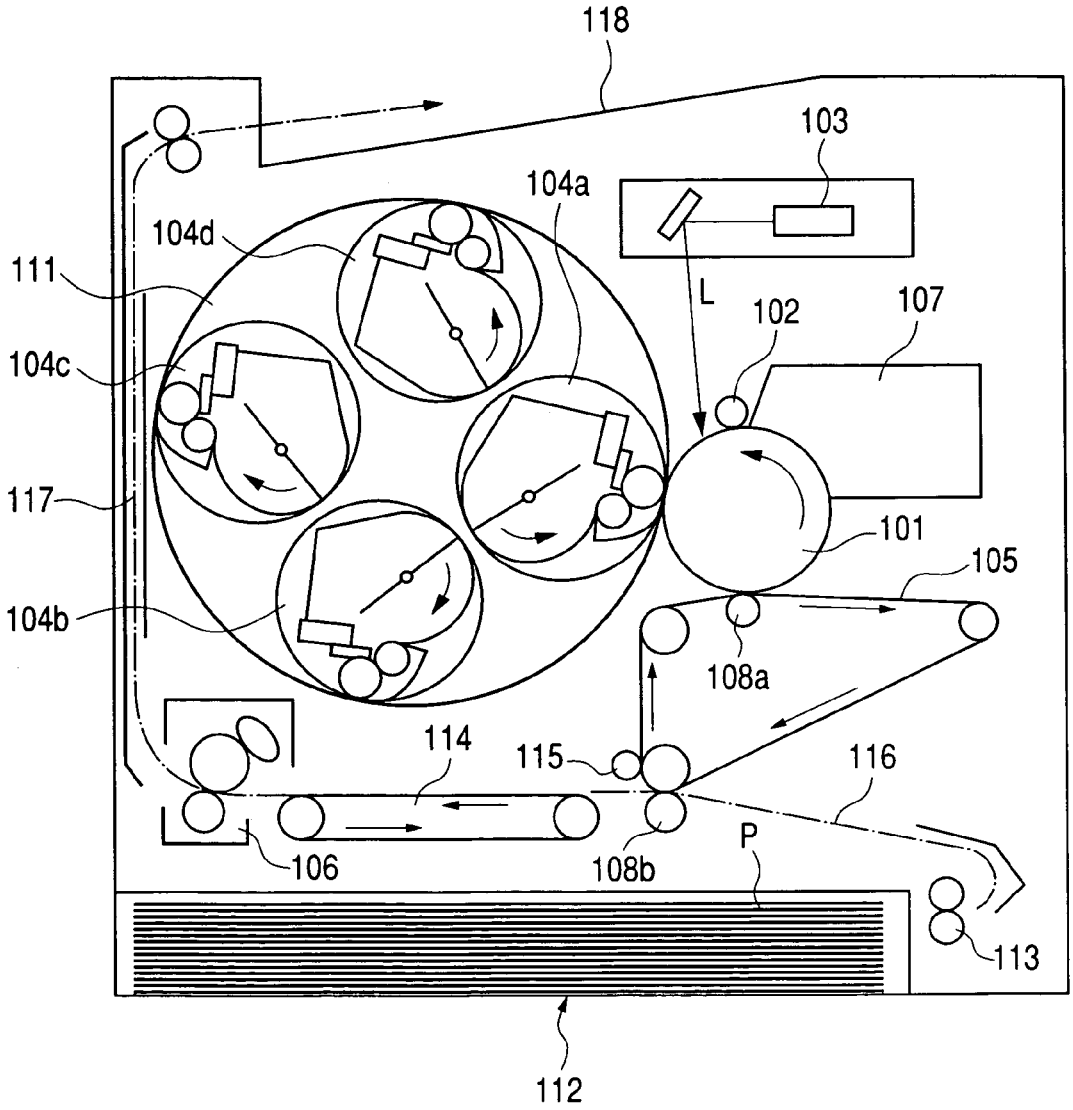
FIG. 5 is a cross-sectional view showing an entire configuration of an image forming apparatus.
Figure 6:
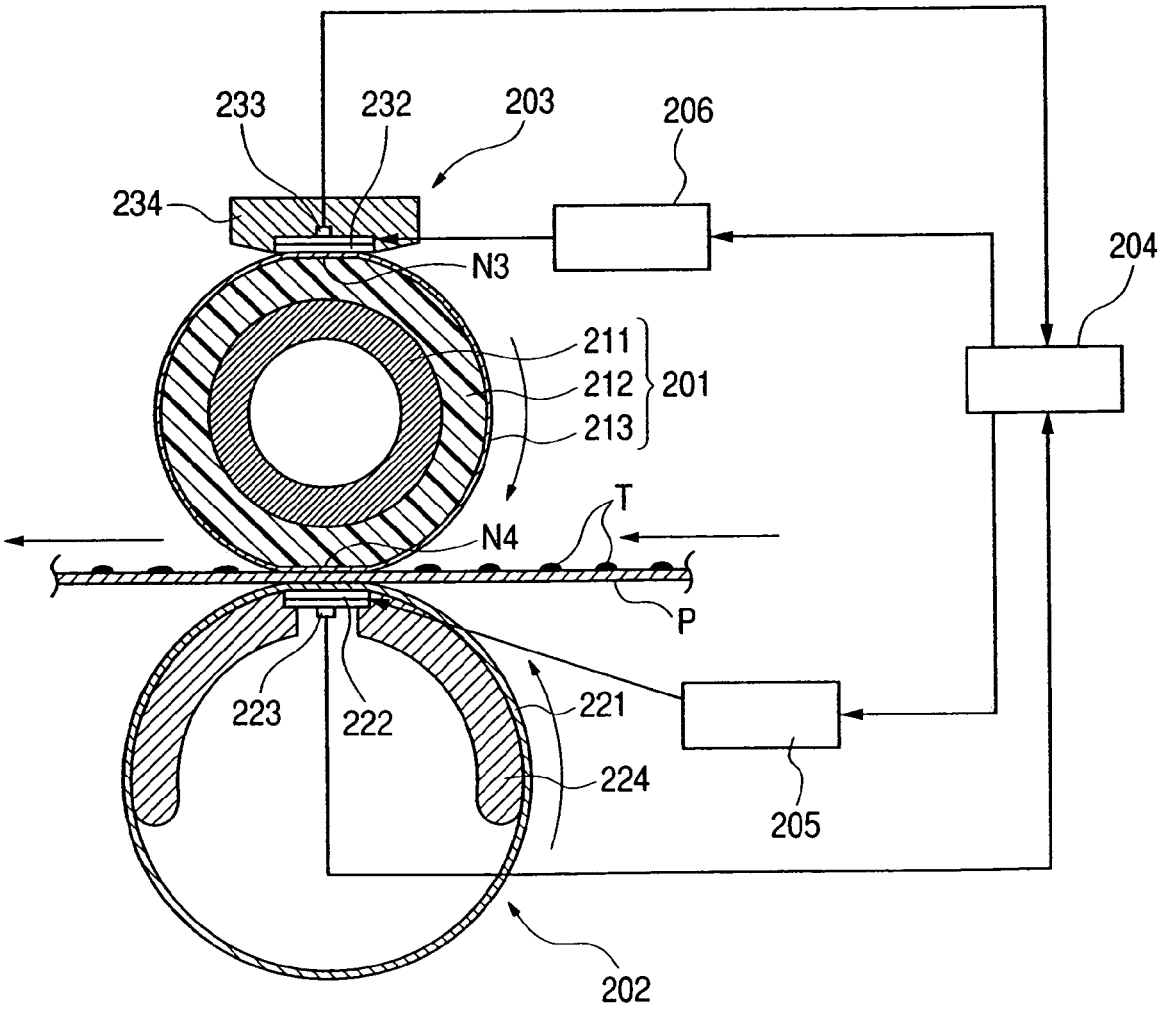
FIG. 6 PRIOR ART
FIG. 6 is a cross-sectional view showing a configuration of a prior heat fixing apparatus.

FIG. 5 is a schematic view showing a configuration of an image forming apparatus employing an image heating apparatus of the present invention. The image forming apparatus of this example is a color laser printer utilizing an electrophotographic process of an intermediate transfer belt type.

a) Full Color Mode

A photosensitive drum 101, constituting an image bearing member, is rotated counterclockwise, as indicated by an arrow, by unillustrated drive means, and is uniformly charged in a predetermined potential of a predetermined polarity by a primary charger 102.

Then it is subjected to a laser scanning exposure L by an exposure apparatus (laser scanner) 103 whereby an electrostatic latent image is formed corresponding to an image pattern of a yellow component of a full-color image.

As the photosensitive drum 101 is rotated further, developing apparatuses 104*a*, 104*b*, 104*c* and 104*d* supported by a rotary support member 111 are so rotated that the developing apparatus 104*a*, containing a yellow toner, is opposed to the photosensitive drum 101, and the aforementioned electrostatic latent image is rendered visible by the developing apparatus 104*a*. The developing apparatuses 104*b*, 104*c* and 104*d* respectively contain a magenta toner, a cyan toner and a black toner.

An intermediate transfer belt 105 is rotated clockwise, as indicated by an arrow, with a speed substantially same as that of the photosensitive drum 101, and the toner image formed and borne on the photosensitive drum 101 is primary transferred onto an external peripheral surface of the intermediate transfer belt 105, by a primary transfer bias applied to a primary transfer roller 108*a*. On the other hand, a transfer residual toner, remaining on the photosensitive drum 101, is removed by a cleaning apparatus 107 constituted of blade means.

A toner image forming step on the photosensitive drum 101 and a primary transfer step onto the intermediate transfer belt 105 are repeated in a similar manner also for an image pattern of a magenta component, an image pattern of a cyan component and an image pattern of a black component of the full-color image, whereby a synthesized color image, formed by superposed toner images of plural colors (yellow, magenta, cyan, and black), is formed on the intermediate transfer belt 105.

Then, at a predetermined timing, a recording material P is supplied by a pickup roller 113 from a recording material cassette 112, and is introduced through a sheet path 116 into a secondary transfer nip portion where a secondary transfer roller 108*b* and the intermediate transfer belt 105 are mutually pressed, and a secondary transfer bias is applied at the same time to the secondary transfer roller 108*b*, whereby the aforementioned synthesized color toner image is collectively transferred from the intermediate transfer belt 105 onto the recording material P.

Then the recording material P is conveyed by a conveyor belt 114 to a heat fixing apparatus 106 for fixation by fusing, and is discharged through a sheet path 117 to an external sheet discharge unit 118 as a color print (color copy).

The fixing apparatus 106 is a heating apparatus of an external heating configuration according to the present invention. It will be explained in more detailed in following (2).

A transfer residual toner on the intermediate transfer belt 105 is given a charge by an intermediate transfer cleaning roller 115, then is inversely transferred to the photosensitive drum 101 at a next primary transfer, and is eliminated from the photosensitive drum 101 by the cleaning apparatus 107.

b) Monochromatic (Black-and-White Copy) Mode

A latent image is formed on the photosensitive drum 101 in the same manner as in a color image formation, then a toner image is formed on the photosensitive drum 101 by the developing apparatus 104*d* containing the black toner, and is primary transferred onto the intermediate transfer belt 105. Then the monochromatic toner image thus formed alone is secondary transferred onto the recording material P and is fixed by the fixing apparatus 106 in a similar manner, whereby a black monochromatic image can be obtained. Thus, a time required for all the image formation on the intermediate transfer belt 105 is reduced to about ¼ in comparison with a case of a color image formation.

(2) Fixing Apparatus 106

Figure 1:
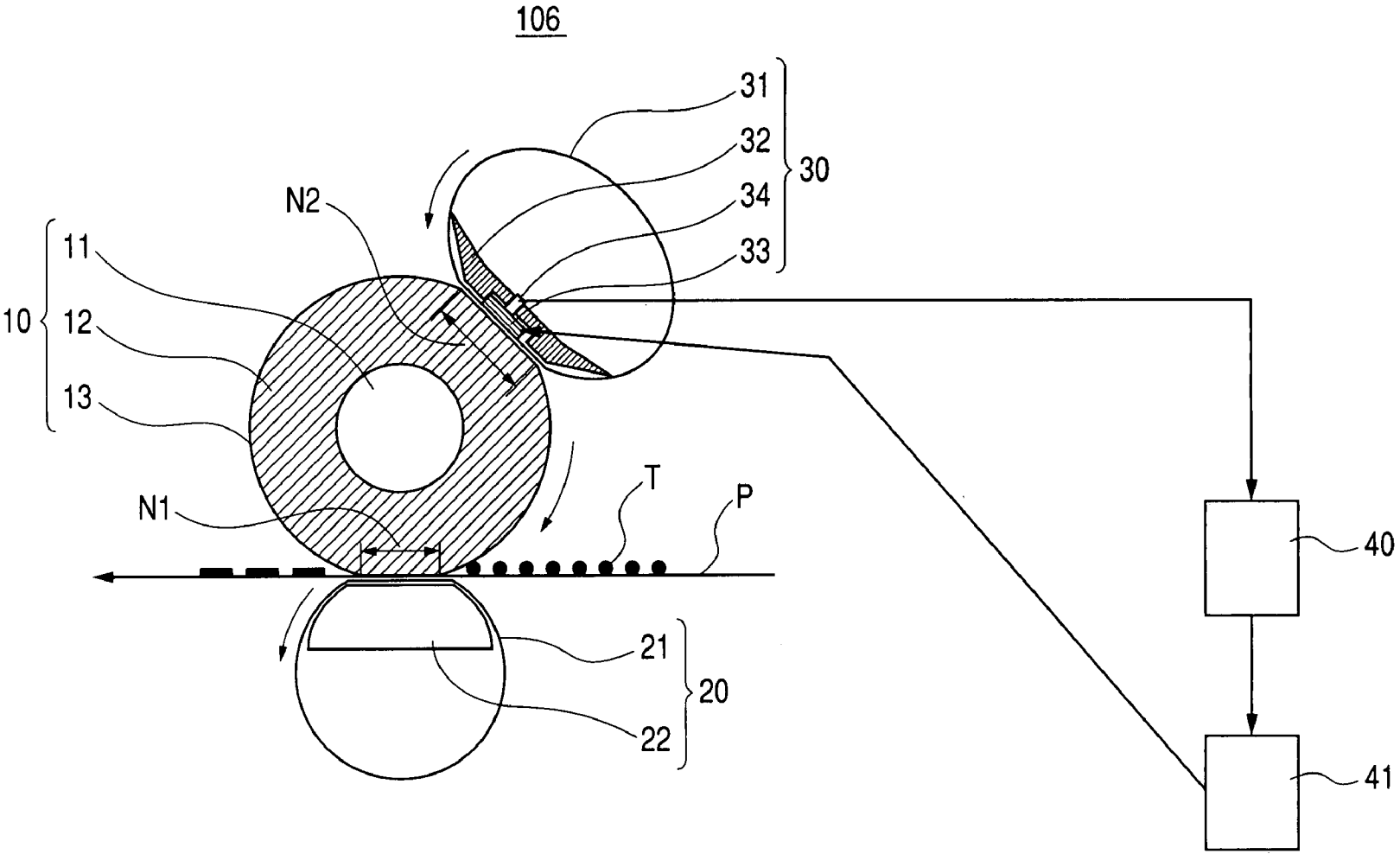
FIG. 1 is a cross-sectional view showing a configuration of a heat fixing apparatus constituting a first embodiment of the present invention.

FIG. 1 is a schematic view showing a configuration of the fixing apparatus 106 in the present embodiment. The fixing apparatus of the present embodiment is primarily constituted of three parts, namely a fixing roller (recording material conveying roller) 10 having an elastic layer, back-up means 20 maintained in contact with the fixing roller 10 thereby forming a fixing nip portion (conveying nip portion) N1, and heat supply means 30 maintain in contact with the fixing roller 10 in a position other than the fixing nip portion and serving to heat the surface of the fixing roller 10. A contact between the heat supply means 30 and the external periphery of the fixing roller 10 forms a heating nip portion N2.

a) Fixing Roller 10

The fixing roller 10 is constituted of a metal core 11 of aluminum or iron, an elastic layer 12 provided on the outside thereof, and a releasing layer 13 covering the surface of the elastic layer 12.

The elastic layer 12 is constituted, for example, of a solid rubber layer formed for example of silicone rubber, a sponge rubber layer formed by foaming silicone rubber in order to obtain a heat insulating effect, or a bubble dispersed rubber layer formed by dispersing a hollow filler in a silicone rubber layer in order to increase a heat insulating effect. In order that the fixing apparatus can be started up to a fixable state rapidly after the start of power supply, there is desired a configuration in which the heat supplied from the external periphery of the fixing roller is not easily transmitted to the interior thereof, so that the elastic layer 12 preferably has a high heat insulating property, such as in the sponge rubber layer or the bubble dispersed rubber layer.

The releasing layer 13 is preferably formed constituted of a fluorinated resin such as perfluoroalkoxy resin (PFA), polytetrafluoroethylene resin (PTFE), or tetrafluoroethylene-hexafluoropropylene resin (FEP), or a fluorinated rubber such as GLS latex (trade name, manufactured by Daikin Co.). A covering on the elastic layer 12 can be formed for example by a method of forming these materials into a tube and fitting such tube, or a method of coating with a paint.

b) Back-Up Means 20

The back-up means 20 is provided with a cylindrical (endless belt-type) film (flexible rotary member) 21, and a film holder 22 (hereinafter represented simply as a holder 22) supporting the film from the interior thereof in contact with the fixing roller 10 thereby forming a fixing nip portion N1.

The cylindrical film 21 is loosely fitted on the external periphery of the holder 22. A pressure is applied between longitudinal ends of the holder 22 and longitudinal ends of the fixing roller 10, by unillustrated pressurizing means such as coil springs. Such configuration forms a fixing nip portion N1 between the fixing roller 10 and the back-up means 20 and across the film 21.

The film 21 is constituted of a resinous film, having a base layer of polyimide, polyamidimide, PEEK, PES, PPS, PFA, PTFE, FEP etc. having a heat resistance and a heat insulating property. It is surfacially covered singly with or by a mixture of a heat-resistant resin having a releasing property such as PFA, PTFE, FEP, silicone resin etc. It may also be constituted of a metal film.

The holder 22 is constituted of a heat-resistant resin with a heat resistance and a slidable property, such as a liquid crystal polymer, a phenolic resin, PPS, PEEK etc.

c) Heat Supply Means 30

The heat supply means 30 is provided with a rotatable cylindrical (endless belt-type) heating film (flexible rotary member) 31, a plate-shaped heater 33, and a holder 32 supporting the film 31 from the inside thereof and also supporting the plate-shaped heater 33 as a heat source. A pressure is applied between longitudinal ends of the holder 32 and longitudinal ends of the fixing roller 10, by unillustrated pressurizing means such as coil springs. Such configuration form a heating nip portion N2 between the fixing roller 10 and the heat supply means 30 and across the film 31. The cylindrical film 31 is loosely fitted on the external periphery of the holder 32. The plate-shaped heater 33 is so-called ceramic heater, and is fixed by fitting in a fitting groove provided in the holder 32, which is pressed to the fixing roller 10 by unillustrated pressurizing means thereby the heater forms a heating nip portion N2 in cooperation with the fixing roller 10 across the heating film 31.

The plate-shaped heater 33 constituting the heat source is not limited to a ceramic heater, but can also be a positive temperature coefficient (PTC) heater, an electromagnetic induction heat generating member, a nichrome heater etc.

Temperature detection means 34 detects a temperature on a rear surface of the heater 33. It is provided, in case of a contact-type thermistor, with a temperature detecting surface thereof in contact with the rear surface of the heater 33, but, in case of a non-contact infrared temperature sensor, opposed to the rear surface of the heater 33 in non-contact manner.

The film 31 is constituted of a resinous film, having a base layer of polyimide, polyamidimide, PEEK, PES, PPS, PFA, PTFE, FEP etc. having a heat resistance and a heat insulating property. It is surfacially covered singly with or by a mixture of a heat-resistant resin having a releasing property such as PFA, PTFE, FEP, silicone resin etc. It may also be constituted of a metal film.

The holder 32 is constituted of a heat-resistant resin with a heat resistance and a slidable property, such as a liquid crystal polymer, a phenolic resin, PPS, PEEK etc.

The ceramic heater 33 serving as a heater is provided with an insulating ceramic substrate such as of alumina or aluminum nitride, or a heat-resistant resinous substrate such as of polyimide, PPS or liquid crystal polymer, on a surface of which a heat-generating resistance layer for example of Ag/Pd (silver-palladium), $RuO_2$ or $Ta_2N$ is formed, by coating for example with screen printing in a linear or stripe form of a thickness of about 10 μm and a width of 1 to 5 mm followed by sintering. At an end of the surface of the heater 33, there is provided a power supply electrode portion which is electrically connected with the heat-generating resistor layer and to which a voltage is supplied from a power supply circuit 41 through an unillustrated power supply connector.

The fixing roller 10 is rotated clockwise, as indicated by an arrow, by an unillustrated drive mechanism. By such rotating motion of the fixing roller 10, the cylindrical film 21 of the back-up means 20 is driven counterclockwise, as indicated by an arrow, around the holder 22, with an internal surface of the film in sliding contact with the surface, opposed to the fixing nip portion, of the holder 22 at the fixing nip portion N1.

Also the cylindrical film 31 of the heat supply means 30 is driven counterclockwise, as indicated by an arrow, around the holder 32, with an internal surface of the film in sliding contact with the surface of the plate-shaped heater 33 at the heating nip portion N2.

The heater 33 of the heat supply means 30 causes a rapid temperature increase by a current supply from the power supply circuit 41 to the heat-generating resistor layer. The heat from the heater 33 heatgs the surface of the fixing roller 10 across the film 31 at the heating nip portion N2. The temperature of the rear surface of the heater 33 is detected by the contact or non-contact temperature detection means 34. Temperature information of the rear surface of the heater 33, detected by the temperature detection means 34, is supplied to a control circuit (CPU) 40. The control circuit 40 controls the power supply from the power supply circuit 41 to the heater 33 in the heat supply means 30, in such a manner that the temperature detected by the temperature detection means 34 is maintained at a predetermined surface temperature (fixing temperature) of the fixing roller.

In the following, feature portions of the present invention will be explained. In the following, a fixing nip portion (conveying nip portion) N1 and a heating nip portion N2 respectively indicate a nip area formed between the back-up means 20 and the fixing roller 10, and a nip area formed between the heat supply means 30 and the fixing roller 10. In the present embodiment, as shown in FIG. 1, the heating nip portion N2 is formed not only between the heater 33 and the fixing roller 10 but also between the holder 32 supporting the heater 33 and the fixing roller 10. Therefore, the heating nip portion N2 is so defined as to include also a nip area formed between the holder 32 and the fixing roller. The nip area is defined in a similar manner also in case the heater is provided at the side of the back-up means.

In the present embodiment, an area of the heating nip portion N2 is made larger than an area of the fixing nip portion N1. Therefore, an arbitrary point on the surface of the fixing roller takes a longer time in passing the heating nip portion N2 than in passing the fixing nip portion N1, whereby the heat supply means 30 can supply, in the heating nip portion N2, the fixing roller 10 with a heat amount sufficiently larger than a heat amount required in the fixing nip portion N1 for fixing the toner image T on the recording material P.

As a result, it is rendered possible to supply the fixing roller 10 with a sufficient heat even without increasing the electric power supplied to the heater 33 and to suppress deterioration of the fixing roller 10. In such situation, also the film 31 after passing the heating nip portion N2 reaches a certain high temperature, so that a sufficient heat can be supplied to the fixing roller 10 even with a small width of the heater 33.

Furthermore, the fixing nip portion N1 formed with a small area allows to prevent a hot offset phenomenon resulting from an excessive heat supply at the fixing nip portion N1.

As a result, the surface temperature of the fixing roller 10 can be stabilized with an enlarged margin against the hot offsetting, so that it is rendered possible to improve the fixing property for a first print immediately after the start of power supply or for all the prints in a continuous sheet passing operation.

Furthermore, in the present embodiment, a total pressure in the fixing nip portion N1 constituting a first nip portion is made larger than a total pressure in the heating nip portion constituting a second nip portion (a total pressure in the second nip portion being smaller than a total pressure in the first nip portion). Stated differently, the total pressure is so selected as to satisfy a relation N1>N2 in spite of a fact that the width of the fixing nip portion N1 is smaller than that of the heating nip portion N2. A local pressure therefore becomes large in the fixing nip portion N1, thereby further improving the fixing property for a first print immediately after the start of power supply or for all the prints in a continuous sheet passing operation.

Figure 7:
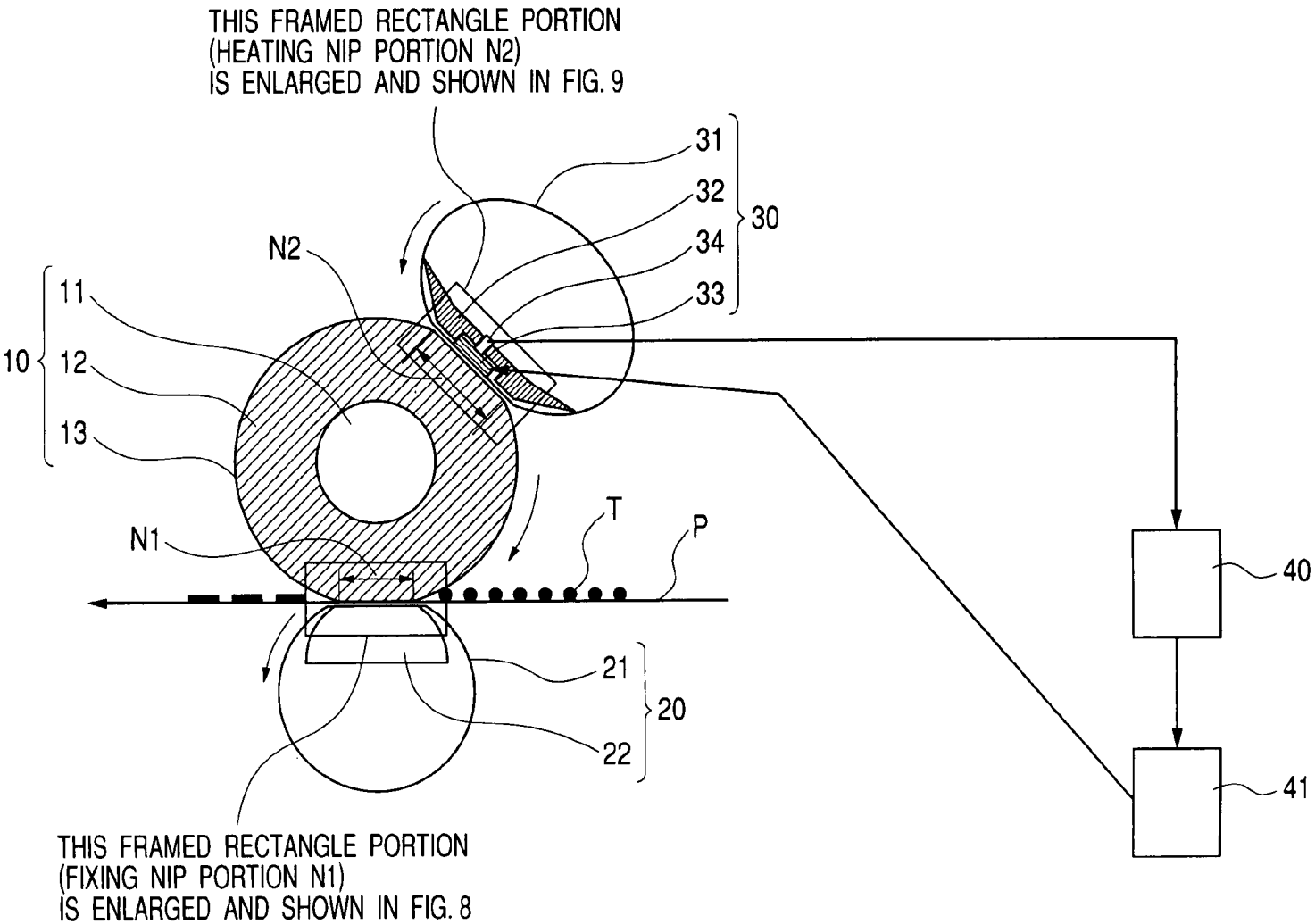
FIG. 7 is a cross-sectional view of a heat fixing apparatus in which a holder for back-up means has a reduced width.
Figure 8:
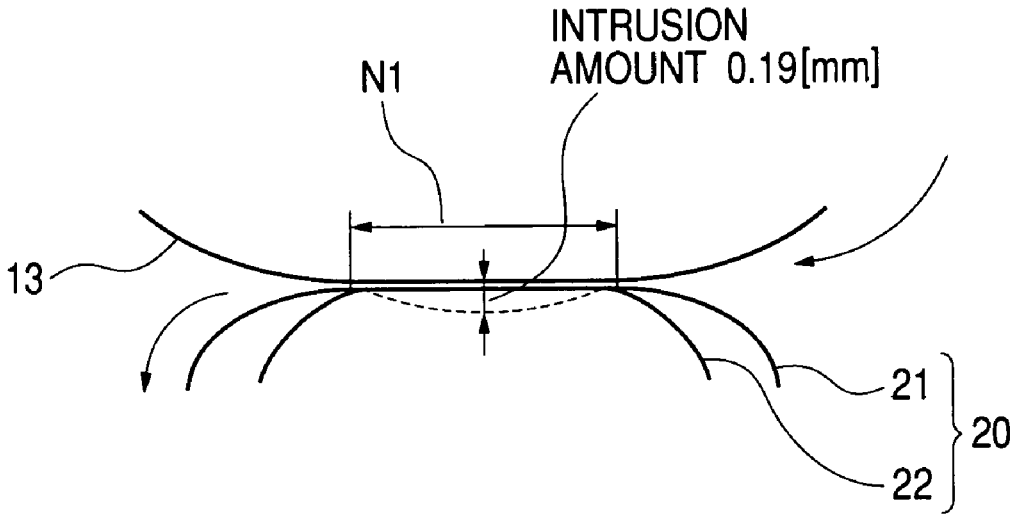
FIG. 8 is a magnified view of a fixing nip portion N1.
Figure 9:
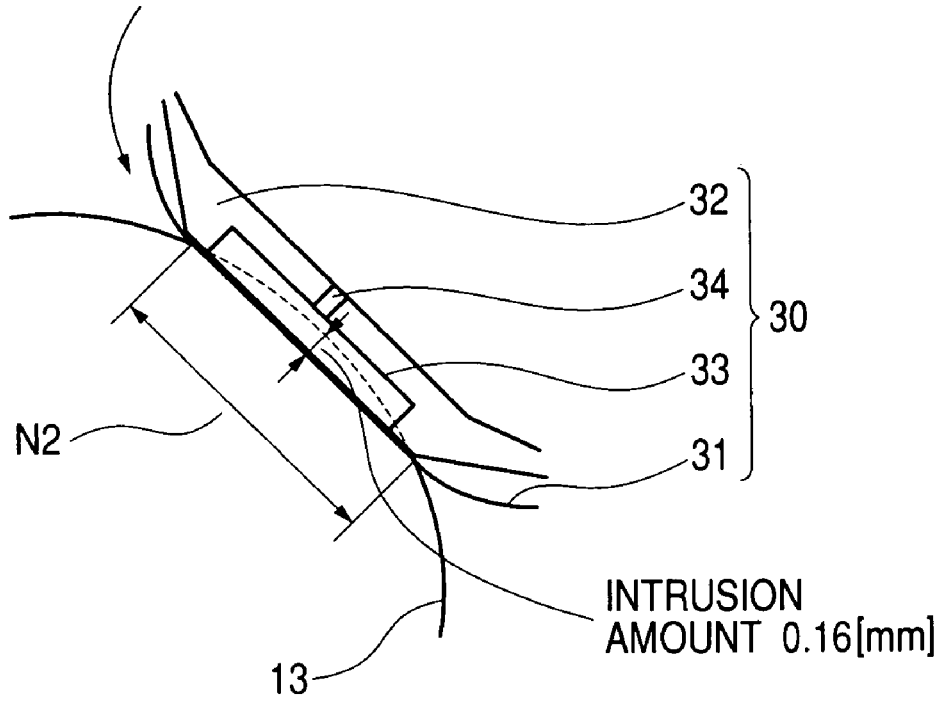
FIG. 9 is a magnified view of a heating nip portion N2.

The holder 22 of the present embodiment is so formed as illustrated in FIG. 1, but, by selecting, as shown in FIG. 7, the width in the conveying direction of the recording material, particularly the width of a nip forming surface of the holder 22 smaller than that shown in FIG. 1, it is rendered easier to select the total pressure applied in the fixing nip portion N1 larger than that in the heating nip portion N2 while maintaining the width of the fixing nip portion N1 smaller than that of the heating nip portion N2. In any case, the width of a fixing nip forming surface of the holder 22 in the back-up means is to be made smaller than the width of a heating nip forming surface of the holder 32 in the heat supply means. In case the relations of the width and the total pressure are selected as explained above in the fixing nip portion N1 and the heating nip portion N2, an intrusion amount of the back-up means 20 or the heat supply means 30 into the fixing roller 10 (namely a maximum recessed amount of the fixing roller 10) becomes larger in the fixing nip portion N1 than in the heating nip portion N2, as shown in FIGS. 8 and 9. FIGS. 8 and 9 respectively show intrusion amounts in the fixing nip portion N1 and in the heating nip portion N2. Thus, a peak value in a pressure distribution in the fixing nip portion N1 also becomes larger than a peak value in a pressure distribution in the heating nip portion N2, thereby providing an improvement in the fixing property, such as an increase in the gloss of the image outputted from the image forming apparatus.

As a specific example, the fixing roller 10 in the present embodiment was formed by providing, outside an aluminum metal core 11 of an external diameter of 13 mm, a heat resistant elastic layer 12 of a thickness of 3.5 mm such as of silicone rubber or fluorinated rubber, and forming thereon a releasing layer 13 by coating or with a tube of a resin such as PFA or PTFE of a thickness of 50 μm.

Also the back-up means 20 was constituted of an endless film 21 of a cylindrical shape formed by coating a substrate of polyimide resin etc. of an external diameter of 20 mm and a thickness of 50 μm with a highly releasing material such as PFA resin with a thickness of 10 μm, and a holder 22. The holder 22 had a width of the fixing nip forming surface in the film rotating direction, of 8 mm approximately same as that of the fixing nip portion N1.

Also the heat supply means 30 was constituted of an endless film 31 of a cylindrical shape formed by coating a substrate of polyimide resin etc. of an external diameter of 22 mm and a thickness of 40 μm with a highly releasing material such as PFA resin with a thickness of 10 μm, a holder 32, a heater 33, and temperature detection means 34 on a surface of the heater 33, not in contact with the film 31. The holder 32 had a width of the heating nip forming surface in the film rotating direction, of 9 mm approximately same as that of the heating nip portion N2.

Under conditions of a width of the heater 33 of 8 mm, an electric power of 600 W charged into the heater 33 and a process speed of 100 mm/sec, there were employed a total pressure of 196 N (20 kgf) in the fixing nip portion N1 and a total pressure of 147 N (15 kgf) in the heating nip portion N2, thereby obtaining a width of 8 mm in the fixing nip portion N1 and a width 9 mm in the heating nip portion N2, thus providing a satisfactory fixing performance. In this state, the fixing nip portion N1 had an intrusion amount of 0.19 mm and the heating nip portion N2 had an intrusion amount of 0.16 mm.

The present embodiment employed a configuration that the cylindrical film 21 of the back-up means 20 and the cylindrical film 31 of the heat supply means 30 are driven by the rotation of the fixing roller 10, but a satisfactory fixing performance can naturally be obtained for example by a configuration in which a driving roller is provided inside the endless film and the film is rotated by driving such drive roller.

(Second Embodiment)

Figure 2:
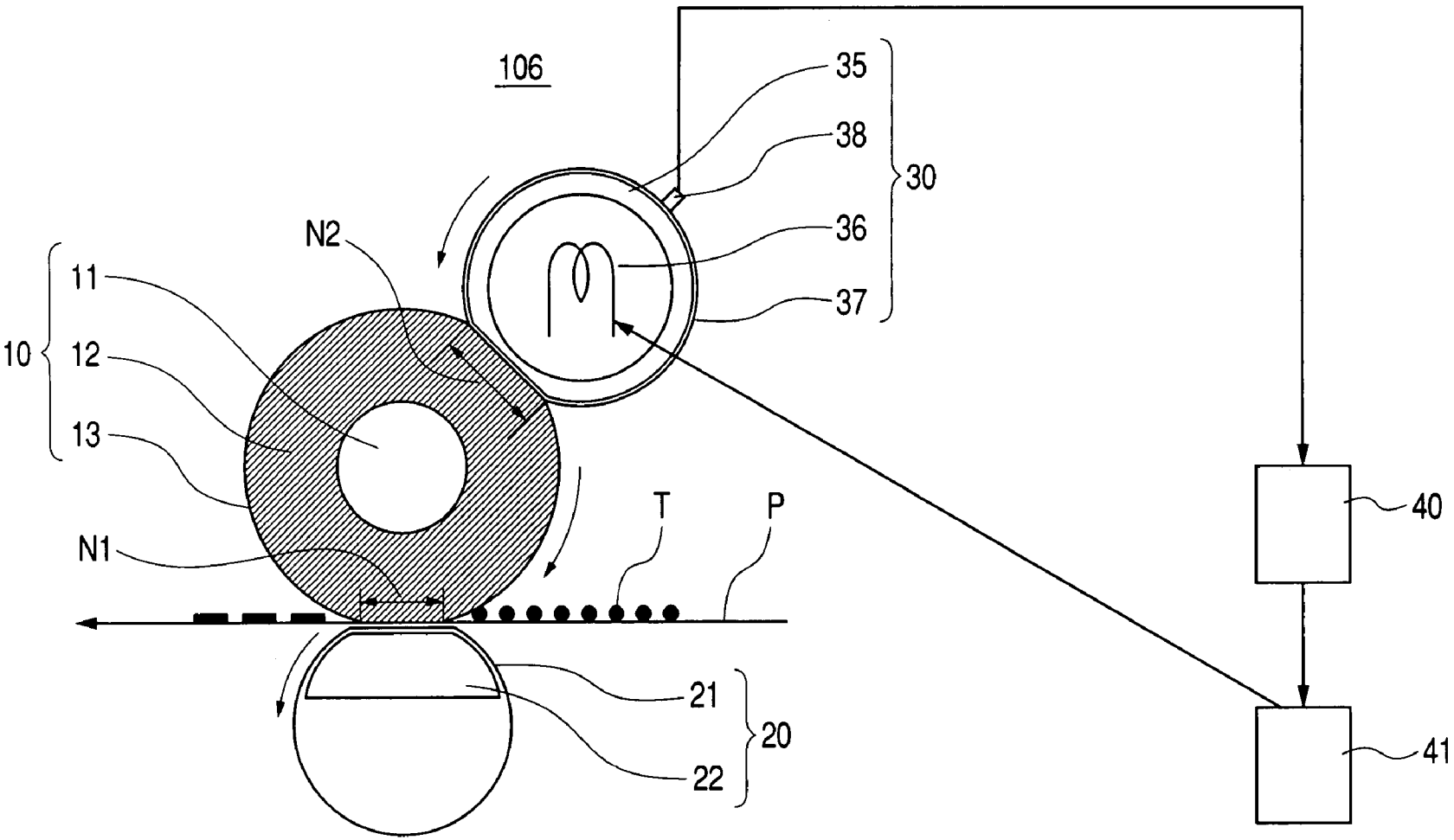
FIG. 2 is a cross-sectional view showing a configuration of a heat fixing apparatus constituting a second embodiment of the present invention.

FIG. 2 shows a second embodiment. A configuration of the image forming apparatus, including the heat fixing apparatus of the present embodiment, is same as that of the first embodiment, explained in FIG. 5, and will not, therefore, be explained. The present embodiment corresponds to the heat fixing apparatus 106 shown in FIG. 5, of which details will be explained with reference to FIG. 2. In the following, components same as or equivalent in function to those in FIG. 1 are represented by same numbers and are omitted from explanation.

The fixing apparatus 106 of the present embodiment is characterized in that the heat supply means 30 is constituted of a heat roller (non-flexible rotary member). The fixing roller 10 and the back-up means 20 have a configuration same as that in the first embodiment.

The heat roller 30 constituting the heat supply means is provided with a heat-generating member 36 such as a halogen lamp inside a hollow metal core 35 of aluminum or stainless steel, and a releasing layer 37 of fluorinated resin etc. for preventing toner offsetting on the external surface of the metal core 35.

The heat supply means 30 is maintained in pressure contact with the fixing roller 10 by unillustrated pressurizing means, whereby the heat roller 30 containing the heat-generating member 36 therein forms a heating nip portion N2 in cooperation with the fixing roller 10.

In the heat-generating member 36 of the heat supply means 30, a current supply to the heat-generating member 36 from the power supply circuit 41 is controlled by the control circuit (CPU) 40, based on a surface temperature information of the heat roller 30 detected by the temperature detection means 38 and taking, as a target temperature, a surface temperature of the fixing roller 10 required for fixing the toner image T on the recording material P at the fixing nip portion N1, in such a manner that the surface temperature of the fixing roller 10 is maintained at such target temperature.

In the fixing apparatus 106 of the aforementioned configuration, an area of the heating nip portion N2 constituting a second nip portion is made larger than an area of the fixing nip portion N1 constituting a first nip portion, and a total pressure applied at the fixing nip portion N1 is made larger than a total pressure applied at the heating nip portion N2.

The use of the above-described heat roller system having a heat-generating member in the interior of a hollow metal core as the heat supply means allows, in addition to the effects of the first embodiment, to increase the pressure to the fixing roller in the fixing nip portion, thereby enabling a more efficient heat supply to the fixing roller. Also a reduction in the diameter can be realized.

(Third Embodiment)

Figure 3:
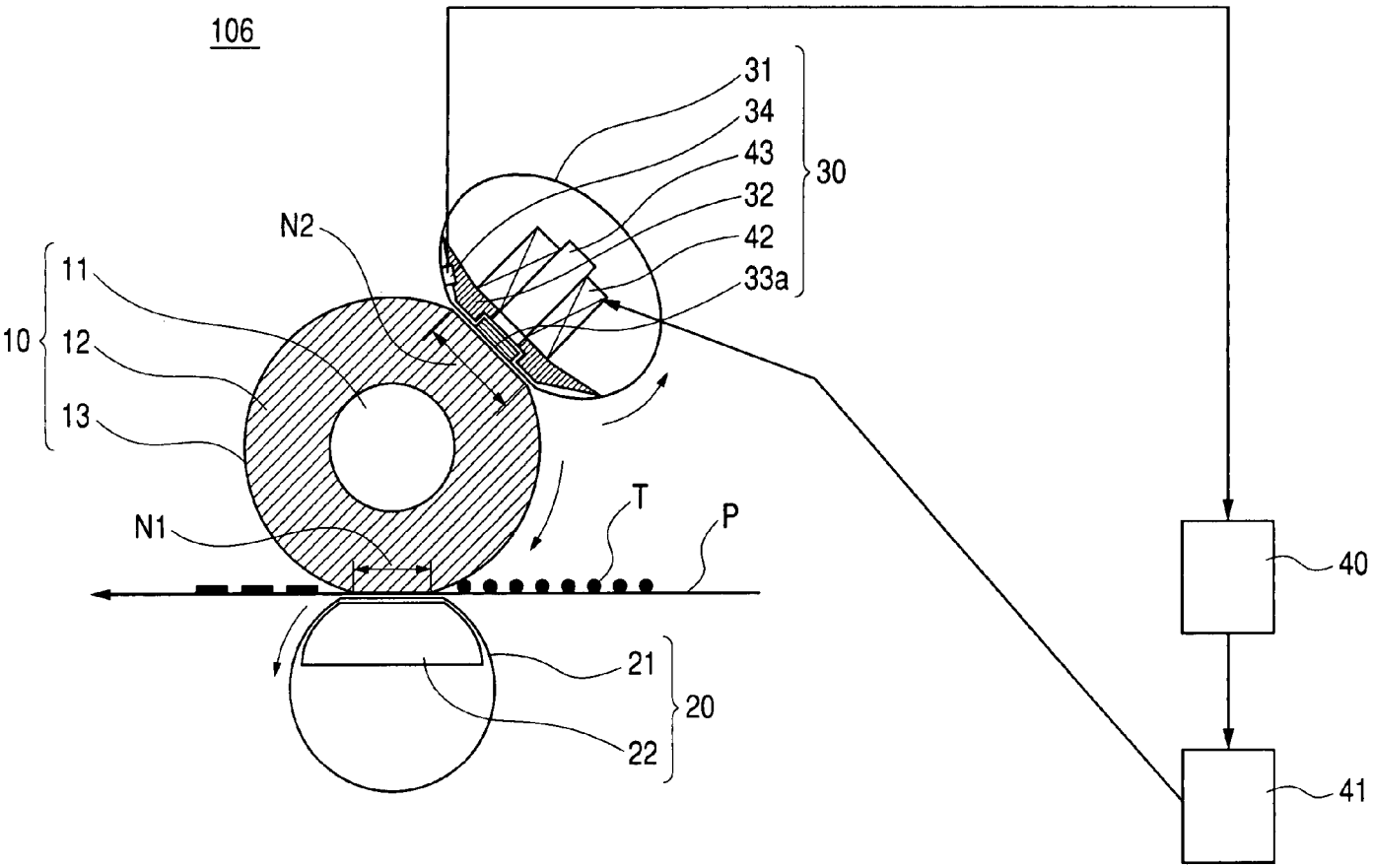
FIG. 3 is a cross-sectional view showing a configuration of a heat fixing apparatus constituting a third embodiment of the present invention.

FIG. 3 shows a third embodiment. A configuration of the image forming apparatus, including the heat fixing apparatus of the present embodiment, is same as that of the first embodiment, explained in FIG. 5, and will not, therefore, be explained. The present embodiment corresponds to the heat fixing apparatus 106 shown in FIG. 5, of which details will be explained with reference to FIG. 3. In the following, components same as or equivalent in function to those in FIG. 1 are represented by same numbers and are omitted from explanation.

The fixing apparatus 106 of the present embodiment is featured in employing heat supply means 30 of electromagnetic induction heating type. The heat supply means 30 is constituted in the fixing apparatus of the first embodiment, by modifying the ceramic heater constituting the heater 33 of the heat supply means 30 to an induction heat-generating member 33*a* such as an iron plate, and by providing an excitation coil 42 and a magnetic core 43 as magnetic field generating means for causing an induction heating in such member 33*a*. The fixing roller 10 and the back-up means 20 have a configuration same as that in the first embodiment.

Under a high frequency magnetic field generated by a high frequency current supplied from an excitation circuit 41 to the excitation coil 42, the member 33*a* generates an induction heat, and the external periphery of the fixing roller 10 is heated by such induced heat, across the film 31 at the heating nip portion N2.

A current supply to the excitation coil 42 of the heat supply means 30 from the power supply circuit 41 is controlled by the control circuit (CPU) 40, based on temperature information detected by the temperature detection means 34 in the heat supply means 30 and taking, as a target temperature, a surface temperature of the fixing roller 10 required for fixing the toner image T on the recording material P at the fixing nip portion N1, in such a manner that the surface temperature of the fixing roller 10 is maintained at such target temperature.

In the fixing apparatus 106 of the aforementioned configuration, an area of the heating nip portion N2 constituting a second nip portion is made larger than an area of the fixing nip portion N1 constituting a first nip portion, and a total pressure applied at the fixing nip portion N1 is made larger than a total pressure applied at the heating nip portion N2. In this manner, there can be obtained effects similar to those in the first embodiment.

Instead of employing the member 33*a*, there may be adopted a configuration in which the film 31 itself has an induction heat-generating property. In such configuration in which the film 31 is rendered heat-generating by induction, since the film 31 directly generates heat, there can be obtained advantages of an extremely good heat response, and a satisfactory control on the surface temperature of the fixing roller 10.

(Fourth Embodiment)

Figure 4:
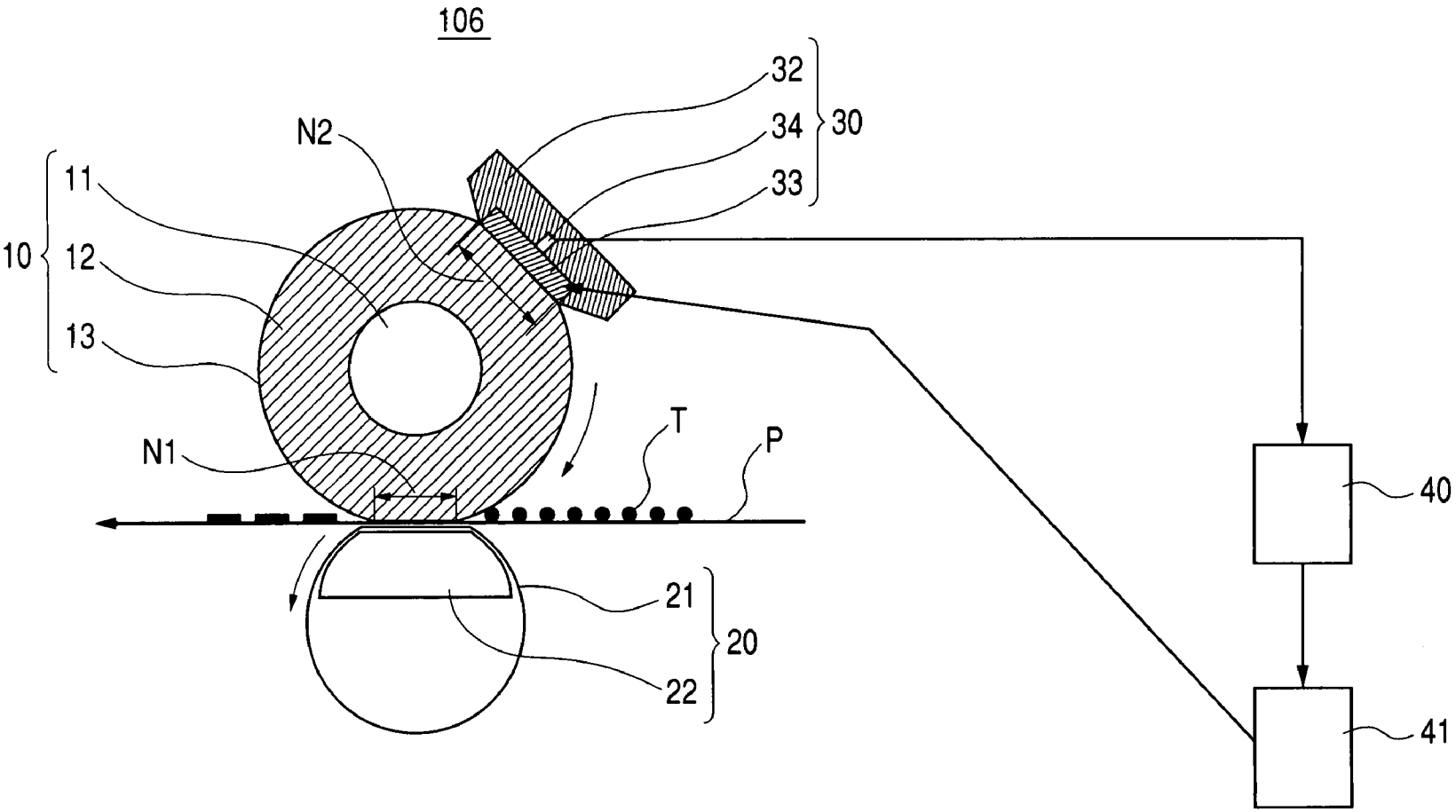
FIG. 4 is a cross-sectional view showing a configuration of a heat fixing apparatus constituting a fourth embodiment of the present invention.

FIG. 4 shows a fourth embodiment. A configuration of the image forming apparatus, including the heat fixing apparatus of the present embodiment, is same as that of the first embodiment, explained in FIG. 5, and will not, therefore, be explained. The present embodiment corresponds to the heat fixing apparatus 106 shown in FIG. 5, of which details will be explained with reference to FIG. 4. In the following, components same as or equivalent in function to those in FIG. 1 are represented by same numbers and are omitted from explanation.

In the fixing apparatus 106 of the present embodiment the heat supply means 30 is constructed by maintaining a ceramic heater, constituting the heater 33 and fixed to the holder 32, in direct contact with the surface of the fixing roller 10, thereby forming a heating nip portion N2 and heating the external periphery of the rotating fixing roller 10. The fixing roller 10 and the back-up means 20 have a configuration same as that in the first embodiment.

A current supply to the heater 33 of the heat supply means 30 from the power supply circuit 41 is controlled by the control circuit (CPU) 40, based on temperature information of the surface temperature of the heater 33, detected by the temperature detection means 34 in the heat supply means 30 and taking, as a target temperature, a surface temperature of the fixing roller 10 required for fixing the toner image T on the recording material P at the fixing nip portion N1, in such a manner that the surface temperature of the fixing roller 10 is maintained at such target temperature.

In the fixing apparatus 106 of the aforementioned configuration, an area of the heating nip portion N2 constituting a second nip portion is made larger than an area of the fixing nip portion N1 constituting a first nip portion, and a total pressure applied at the fixing nip portion N1 is made larger than a total pressure applied at the heating nip portion N2. In this manner, there can be obtained effects similar to those in the first embodiment.

Also the aforementioned configuration can reduce the cost because of a simple structure, and can achieve a very satisfactory heat transmission since the fixing roller 10 can be directly heated with the heater 33 without going through a film or the like.

It is also possible to replace the ceramic heater constituting the heater 33 by a induction heat-generating member as in the apparatus shown in FIG. 3 and to provide an excitation coil and a magnetic core as magnetic field generating means for causing an induction heat in such member.

(Others)

1) The recording material conveying roller 10 is not limited to a non-flexible roller member but can also be constituted of a flexible rotary member such as a rotary belt member.
2) The heating apparatus of the present invention is applicable not only to an image heat-fixing apparatus in the foregoing embodiments, but also to various means and apparatus for a heat treatment of a heated material, such as an image heating apparatus for heating a recording material bearing an image thereby improving a surface property such as a surface gloss, an image heating apparatus for a temporary fixation, a heat drying apparatus for a heated material or a heat laminating apparatus.

The present invention has been explained by various examples and embodiments, but it will be understood, for those skilled in the art, that the concept and the scope of the present invention are not limited to specific explanations and drawings in the present specification but are subject to various modifications and alterations described in appended claims.

What is claimed is:

1. An image heating apparatus for heating an image formed on a recording material, comprising:

a conveying roller for conveying the recording material;

heat supply means which supplies heat to said conveying roller, said heat supply means being in contact with an external periphery of said conveying roller to form a heating nip portion;

back-up means which forms a conveying nip portion in cooperation with said conveying roller for nipping and conveying the recording material;

wherein an image on a recording material conveyed by the conveying nip portion contacts said conveying roller, wherein, in a rotating direction of said conveying roller, the heating nip portion has a width larger than a width of the conveying nip portion, and a total pressure applied to the conveying nip portion is larger than a total pressure applied to the heating nip portion, wherein said heat supply means includes a heat generating member, a holder for supporting said heat generating member, and a flexible rotary member nipped between said conveying roller and said heat generating member and rotating around said holder, and the heating nip portion includes a first heating nip portion which is formed by said heat generating member and said conveying roller through said flexible rotary member and a second heating nip portion which is formed by said holder and said conveying roller through said flexible rotary member, a position of the first heating nip portion and a position of the second heating nip portion being different from each other in the rotating direction of said conveying roller.

2. An image heating apparatus according to claim 1, wherein said conveying roller has an elastic layer, and a maximum recess amount formed in said conveying roller by said back-up means is larger than a maximum recess amount formed in said conveying roller by said heating means.

3. An image heating apparatus according to claim 1, wherein a peak value in the pressure in the conveying nip portion is larger than a peak value in the pressure in the heating nip portion.

4. An image heating apparatus according to claim 1, wherein said heat supply means includes a non-flexible rotary member having a heat source therein, and the heating nip portion is formed between said rotary member and said conveying roller.

5. An image heating apparatus according to claim 1, wherein said heat supply means includes a heat generating member, and the heating nip portion is formed between said heat generating member and said conveying roller.

6. An image heating apparatus according to claim 1, wherein the back-up means includes a flexible rotary member and a holder provided inside said rotary member and supporting said rotary member, and the conveying nip portion is formed between said holder and said conveying roller, across said rotary member.

* * * * *

UNITED STATES PATENT AND TRADEMARK OFFICE

CERTIFICATE OF CORRECTION

PATENT NO. : 7,162,194 B2
APPLICATION NO. : 10/784874
DATED : January 9, 2007
INVENTOR(S) : Yozo Hotta et al.

It is certified that error appears in the above-identified patent and that said Letters Patent is hereby corrected as shown below:

ON THE TITLE PAGE, AT ITEM (57), Abstract:
Line 7, “portion;” should read --portion; and--.

COLUMN 2:
Line 31, “are” should read --is--.

COLUMN 3:
Line 54, “portion;” should read --portion; and--.

COLUMN 4:
Line 28, “the to” should read --to the--.

COLUMN 5:
Line 26, “detailed in following” should read --detail in following section--.

COLUMN 6:
Line 14, “tetrafluoroethye-” should read --tetrafluoroethy- --.
Line 54, “form” should read --forms--.

COLUMN 7:
Line 47, “heatgs” should read --heats--.

COLUMN 8:
Line 25, “allows to prevent” should read --prevents--.

COLUMN 9:
Line 38, “width 9 mm” should read --width of 9 mm--.

COLUMN 10:
Line 53, “to” should read --into--.

UNITED STATES PATENT AND TRADEMARK OFFICE

CERTIFICATE OF CORRECTION

PATENT NO. : 7,162,194 B2
APPLICATION NO. : 10/784874
DATED : January 9, 2007
INVENTOR(S) : Yozo Hotta et al.

It is certified that error appears in the above-identified patent and that said Letters Patent is hereby corrected as shown below:

COLUMN 12:
Line 2, "a" should read --an--.

Signed and Sealed this

Twenty-ninth Day of May, 2007

JON W. DUDAS
*Director of the United States Patent and Trademark Office*